US005725717A

United States Patent [19]

Harte et al.

[11] Patent Number: 5,725,717

[45] Date of Patent: Mar. 10, 1998

[54] APPLICATION OF ROWS OF LABELS TO A PACKAGING FILM

[75] Inventors: James R. Harte, Overland Park, Kans.; Michael L. Kennedy, Grain Valley, Mo.

[73] Assignee: Koch Supplies, Inc., Kansas City, Mo.

[21] Appl. No.: 703,553

[22] Filed: Aug. 27, 1996

[51] Int. Cl.[6] ..... B65C 3/02; B65C 9/00; B65C 9/18

[52] U.S. Cl. ..... 156/299; 156/265; 156/541; 156/542; 156/556; 156/566

[58] Field of Search ..... 156/265, 264, 156/300, 299, 541, 542, 540, 566, 556

[56] References Cited

U.S. PATENT DOCUMENTS 1,327,664 1/1920 Dun Lany ..... 156/299 X
2,254,217 9/1941 Grupe ..... 156/265 X
4,061,521 12/1977 Lerner et al. ..... 156/265
4,475,969 10/1984 Reed ..... 156/265 X

*Primary Examiner*—Jeff H. Aftergut
*Attorney, Agent, or Firm*—Kircher, Bowman & Johnson

[57] ABSTRACT

A method and apparatus for simultaneously placing two spaced rows of labels upon packaging film is disclosed. The apparatus includes a first labeling station at a first roller, a second labeling station at a second roller, belts for transporting two rows of labels across the film for placement at the first and second labeling stations, and a third roller movably positioned with respect to the first and second rollers. The film travels over the first roller, downwardly around the third roller, and then back up over the second roller. The adjacent rows of labels on a single backing are delivered by the belts to the film, where the labels are placed in rows spaced a distance apart greater than their spacing on the backing. Changing the position of the third roller allows a user to vary the spacing between the two rows of labels which are placed on the film at the first and second labeling stations during each film stop.

20 Claims, 2 Drawing Sheets

APPLICATION OF ROWS OF LABELS TO A PACKAGING FILM

FIELD OF THE INVENTION

The present invention relates to a labeling apparatus. More particularly, the invention relates to a method and apparatus for placing labels two rows at a time upon a packaging film.

BACKGROUND OF THE INVENTION

In a variety of product packaging operations, such as where a food product is packaged, it is desirable to place a label on the package. The packager may place the labels manually on the package before or after the package is filled with product. Manual label placement is costly and slow.

Where the product to be packaged is placed or wrapped in a package formed from film stock, packagers have found automated apparatus useful in placing labels on the packaging. In this type of labeling apparatus, rows of labels are placed on a film sheet which is then used to form the packaging.

In these devices, adhesive-backed labels are peeled by a label peeler from their backing. The apparatus transports the peeled labels, such as with a belt, to a desired positioned over the film. A number of labels are positioned across the width of the film in a row, with the film later segmented into narrower strips having labels spaced along the length of each strip. Each strip is then segmented between successive labels, producing film segments each having a single label thereon for use in creating a single package.

The apparatus presses the rows of labels against the film and removes the labels from the delivery belt. The film indexes forward for placement of the next row of labels.

The apparatus transports the labels from a source located on one side of the film across the film (i.e. perpendicular to the direction of film travel). This has the drawback, however, of adding to the time necessary to place the labels. For each row of labels to be placed, the apparatus peels a label and feeds it onto the belt, and then peels another label and feeds it onto the belt, and so on, until the number of labels for a particular row (perpendicular to the length of film) are attached to the belt and transported out across the film into position for pressing onto the film.

Because of the time necessary to peel and transport the row of labels out over the film, the number of labeling cycles per minute in this type of apparatus usually can not exceed approximately 60 cycles per minute (i.e. 60 rows per minute). In many applications, this operation is the slowest of all of the packaging steps, thus constraining the speed of packaging.

For example, in "vertical" packaging operations, packages may be created at an extremely high rate of speed. Here, a film which is transported vertically is separated into halves and which are adhered to one another to form a pocket, such as for containing a powdered drink mix. In this packaging operation, labeling speeds of over 80 cycles per minute may be necessary if the labeling step is not to slow the overall packaging operation.

A need exists for a low cost and fast film labeling apparatus and method.

SUMMARY OF THE INVENTION

The present invention is a method and apparatus for simultaneously placing two rows of labels on a film. The apparatus comprises a film supply, a label supply, a first labeling station, a second labeling station, and a mechanism for routing the film some distance between the first and second labeling stations.

The first labeling station is located at a first roller over which the film extends. The second labeling station is located at a second roller over which the film extends. The first and second rollers are mounted in a common plane.

The means for extending the film between the labeling stations comprises a third roller movably mounted with respect to the first and second rollers. The film extends around the third roller between the first and second rollers.

The supply of labels comprises two rows of labels positioned adjacent one another on a common backing. The labels are fed to a peeler which peels the pairs of adjacent labels from a common backing and delivers them to a first and second belt, respectively. The first belt extends across the film (i.e. parallel to its width) near the first labeling station. The second belt extends across the film near the second labeling station.

A tamping bar is provided for pressing the labels delivered by the belts onto the film at the first and second labeling stations. The tamping bar has a first arm for pressing labels against the film at the first roller, and a second arm for pressing labels against the film at the second roller. The tamping bar is mounted for movement between a first retracted and second depressed position.

The method of placing labels in accordance with the present invention is as follows. Packaging film in the form of sheet stock is delivered to the apparatus and over the first roller. From the first roller, the film extends around the third roller and over the second roller, before continuing on along the desired packaging sequence.

Two rows of adjacent labels on a single backing are provided to the apparatus. Advantageously, even though the labels are delivered from a single-sheet backing in adjacent rows, the user can configure the apparatus to place the rows of labels on the film a variable distance apart. To select the label row separation on the film, the user moves the third roller with respect to the first and second rollers. This changes the length of film between the first and second labeling stations.

With the row separation selected, the apparatus delivers the film and stops it at a first position. Labels are peeled from their backing and delivered to the film. In particular, the labels are peeled and caught by the turning belts. The speed of the belts and the rate and interval at which labels are peeled are chosen so that each belt delivers a row of labels, the labels in each row separated by a desired distance.

Once all of the labels for the two rows have been placed on the belts and the belts rotated into position over the film, the tamping bar lowers and presses the rows of labels connected to the belts against the film. The apparatus then moves the film forward for placement of the next two rows of labels, the rows of labels last placed being pulled completely off of the belts and onto the film.

In this manner, two rows of labels are placed on a film at the same time. The rows of labels may be placed on the film a distance apart which exceeds the distance by which the labels are separated on their common backing sheet.

Further objects, features, and advantages of the present invention over the prior art will become apparent from the detailed description of the drawings which follows, when considered with the attached figures.

DETAILED DESCRIPTION OF THE PREFERRED EMBODIMENT

Figure 1:
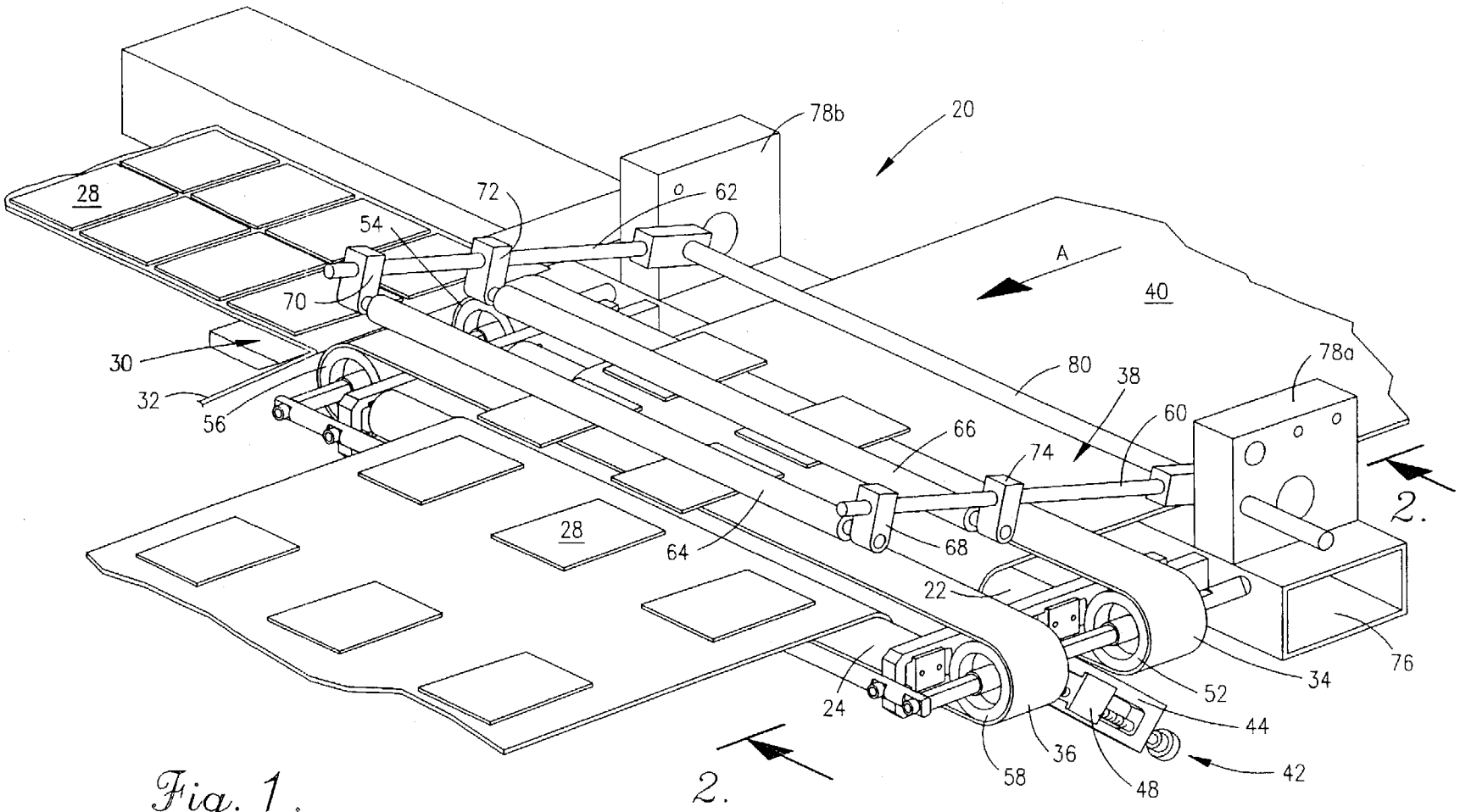
FIG. 1 is a perspective view of an apparatus for placing two rows of labels at the same time in accordance with the present invention.
Figure 2:
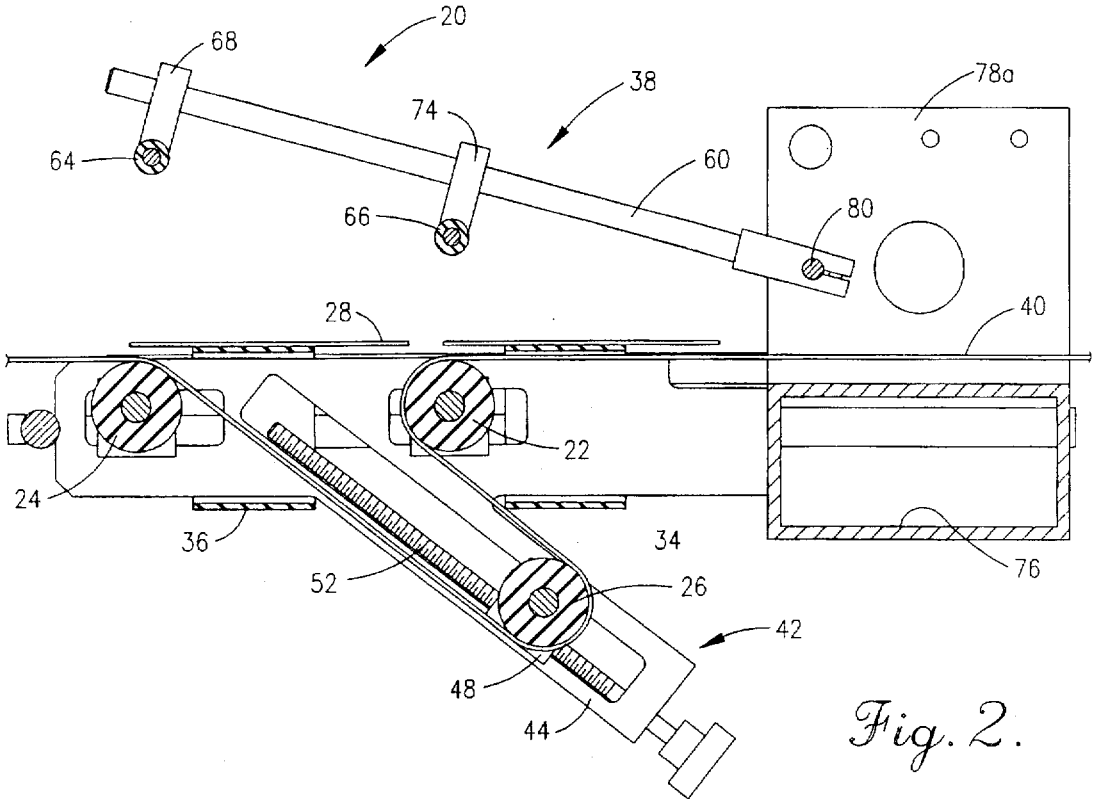
FIG. 2 is a side view of the apparatus of FIG. 1 taken along Line 2—2 therein with a tamping bar of the apparatus illustrated in a retracted position.

FIGS. 1 and 2 illustrate a double row labeling apparatus 20 in accordance with the present invention. With the apparatus 20 of the present invention, two adjacent rows of labels positioned on a common backing are fed to the apparatus 20. The apparatus 20 places the two rows of labels on a packaging film, the spacing between the rows of labels on the film generally being greater than the distance between the labels on the film supply.

Figure 3:
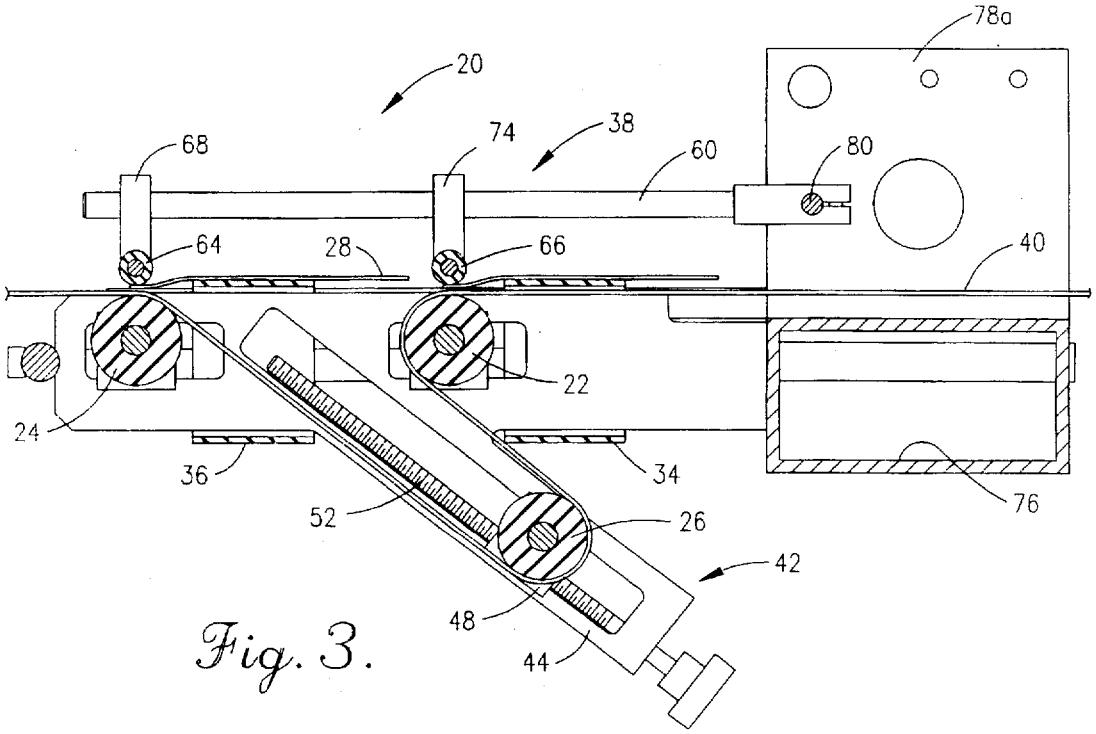
FIG. 3 is a side view of the apparatus of FIG. 2 with the tamping bar illustrated in a depressed position.

In general, the apparatus 20 includes first and second labeling stations and means for adjusting the distance between the rows of labels placed on the film. The first and second labeling stations are located at a first roller 22 and a second roller 24, respectively, over which the film is routed. The means for adjusting the distance between rows of labels, as best illustrated in FIGS. 2 and 3, comprises a third roller 26 around which the film is routed between the first and second rollers. The position of the third roller 26 is adjustable with respect to the first and second rollers 22,24.

The apparatus 20 further includes a label supply. As illustrated in FIG. 1, the label supply provides labels 28 oriented in two adjacent rows on a unitary backing 32 to a peeler 30. The peeler 30 peels the labels 28 from the backing 32 and feeds them to first and second belts 34,36. The belts 34,36 extend across the film 40 transverse to the direction of film travel near the first and second rollers 22,24, respectively.

A tamping bar 38 is movably positioned over the film for engagement with the first and second rollers 22,24. The tamping bar 38 presses labels transported by the belts 34,36 onto the film.

In use, packaging film 40 is fed over the first roller 22. The film 40 then extends downwardly around the third roller 26 and back up over the second roller 24. The two rows of labels 28 are fed to the peeler 30, where they are removed from their common backing 32. The two rows of labels 28 are fed onto the first and second belts 34,36, respectively. Once the rows of labels 28 have been transported out across the film 40 by each belt 34,36, the tamping bar 38 lowers, pressing the portion of the labels 28 overlying the film 40 against the film. The apparatus 20 moves the film 40 forward, pulling the remainder of the labels 28 off of the belts 34,36 and completely into place on the film 40.

Once the apparatus 20 moves the film 40 forward, the process of placing labels two rows at a time repeats itself.

The apparatus 20 will now be described in more detail with reference made to FIGS. 1 and 2. The apparatus 20 includes means for supplying a packaging film 40. The film 40 may be supplied from a roll of packaging film stock or other delivery apparatus known in the art. The film 40 is delivered in the direction of arrow A in FIG. 1. Means are provided, either associated with the apparatus or otherwise, for moving the film 40. These means are well known in the art and may comprise, for example, a pair of motor driven pinch rollers.

The apparatus 20 includes a first labeling station, a second labeling station, and means for routing the film to the stations. The first labeling station is located at a first roller 22. The second labeling station is located at a second roller 24. The first and second rollers 22,24 are mounted in the same plane, and are adjustable from 100 mm to 200 mm apart.

Means are provided for selectively changing the distance between the rows of labels placed on the film 40 at the first and second labeling stations. Preferably, this means comprises a third roller 26 movably mounted with respect to said first and second rollers 22,24, and around which the film extends.

Each roller 22,24,26 preferably comprises a metal cylinder having a smooth outer surface. The cylinder is mounted for rotation about an axis passing through its ends. Each roller 22,24,26 is preferably longer than the width of the film 40, or about 440 mm when the film is 420 mm. Each roller 22,24,26 has a preferred diameter of between 15–30 MM.

All three rollers 22,24,26 are mounted to a frame 76 of the apparatus 20. When the first and second rollers 22,24 are mounted in a common horizontal plane, the third roller 26 is positioned below the plane in which the first and second roller 22,24 are located.

In particular, the third roller 26 is mounted on a slide 42. The slide 42 comprises a first rail 44 and second rail 46 (not shown) connected to the frame 76. Each rail 44,46 is an elongate member having a track in the form of an elongate slot. Preferably, each rail 44,46 is about 150 mm long which creates a maximum spread between labels of 2×150 mm or 300 mm.

The rails 44,46 are mounted at a first end generally between the first and third rollers 22,26. The second end of each rail 44,46 is positioned below the plane containing the first and third rollers 22,26 when they are mounted in a horizontal plane.

The third roller 26 is mounted at its ends to slider blocks 48,50 (only one of which is illustrated). The slider blocks 48,40 are mounted to travel along the tracks of the rails 44,46.

Means are provided for locking the slider blocks 48,50, and thus the third roller 26 in a fixed position along the rails 44,46. Preferably, this means comprises an elongate threaded screw 52 which engages one of the blocks 48 and the rail 44. The screw 52 is arranged such that it freely rotates with respect to the rail 44, but threadingly engages the block 48. Rotation of the screw 52 thereby effectuates movement of the block 48 (and thus the roller 26) thereal-ong.

The apparatus 20 includes means for providing a supply of labels 28 and positioning them on the film 40. Preferably, a single sheet of labels 28 in two adjacent rows are provided on a unitary backing 32. In order to reduce the cost associated with the labels, it is desired that the rows of labels 28 be very close, such as about 5 mm apart.

The labels 28 are fed by a feeder to a label peeler 30, which peels the labels from their backing 30. The mechanism for feeding the sheet containing labels and the peeler are well known in the art.

Means are provided for transporting the rows of peeled labels 38 to the film 40. Preferably, this means comprises a first belt 34 and a second belt 36. Each belt 34,36 is about 40 mm wide and comprised of inverted diamond pattern rubber. As best illustrated in FIG. 1, each belt 34,36 comprises a loop of material extending around a pair of rollers, the rollers mounted on opposite sides of the film 40. The first belt 34 is mounted on a first roller 52 and a second roller 54. The second belt 36 is mounted on a first roller 56 and a second roller 58.

Both belts 34,36 are oriented generally perpendicular to the length of the film and its direction of travel (A), or alternatively stated, generally parallel to the widthwise direction of the film. The top portion of the loop comprising each belt extends over the film 40 and the bottom portion extends underneath the film 40. In other words, each belt 34,36 encircles the film 40.

The portion of each belt 34,36 which extends over the top of the film 40 is positioned adjacent the film 40. Thus, the centerline of the rollers 52–58 on which the belts 34,36 are mounted are below the film 40.

The first belt 34 is positioned adjacent the first roller 22. Preferably, the first belt 34 is positioned adjacent the first roller 22 adjacent its side opposite the second roller 24. The second belt 36 is similarly positioned adjacent the second roller 24.

The apparatus 20 includes means for pressing labels which are transported by the belts 34,36 over the film 40 to the film Preferably, this means comprises a tamping bar 38. The tamping bar 38 comprises a pair of struts 60,62 extending along either side of the film 40 on which are mounted a first arm 64 and a second arm 66.

The struts 60,62 are rotatably mounted at their first ends to an actuating means. Preferably, the actuating means is positioned upstream of the first roller 22. The actuating means comprises a motor (not shown) positioned in one of either a first or second housing 78*a,b*. The motor is connected to the struts 60,62 via an elongate rod 80 having ends which are designed for rotation with respect to the housings 78*a,b*. The motor is arranged to rotate the rod 80, raising and lowering the struts 60,62.

The struts 60,62 are themselves metal rods about 250 mm long. The first arm 64 spans the struts 60,62 some distance between their ends. The second arm 66 spans the struts 60,62 at their second ends. The position of the first arm 64 is chosen such that when the bar 38 is lowered downwardly, it presses against the first roller 22. Similarly, the position of the second arm 66 is selected so that when lowered it presses against the second roller 24.

The arms 64,66 comprise elongate rods having their ends rotatably connected to mounting blocks 68,70,72,74. The mounting blocks 68,70,72,74 are positioned on the struts 60,62 and extend downwardly therefrom. The mounting blocks 68,70,72,74 provide clearance of the struts 60,62 with respect to the belts 34,36.

The method of placing labels two rows at a time upon packaging film in accordance with the present invention is as follows.

A user of the apparatus 20 provides a supply of film 40 from a film supply. The user routes the film 40 over the first roller 22, under the third roller 26, and back up over the second roller 24 and on to a downstream packaging operation.

While the film 40 extends over the first roller 22, it is positioned under the first belt 34. Similarly, while the film 24 extends over the second roller it is positioned under the second belt 36.

A user selects the distance by which the two rows of labels will be placed on the film 40 (i.e. "row separation") by adjusting the position of the third roller 26. The user moves the third roller 26 along the slide 42, changing the distance the film 40 travels between the first and second labeling stations. If the user moves the third roller 26 downwardly away from the first and second rollers 22,24, the distance between rows of placed labels increases by two times the third roller distance. If the user moves the third roller 26 upwardly adjacent the first and second rollers 22,24, the distance between rows of placed labels decreases.

The user supplies labels 28 to the apparatus 20, and then starts the apparatus 20.

The means for moving the film 40 moves the film into a first position for placement of two rows of labels. At this time, the film 40 remains stationary.

The peeler 30 peels labels 28, two adjacent labels at a time, from their common backing 32. The first belt 34 moves, catching one of the labels and transporting it towards the film. At the same time, the second belt 36 moves, catching the other of the two labels and transporting it towards the film. As can be seen in FIG. 2, and as common in prior art labeling devices, the belts 34,36 are oriented with respect to the peeler 30 so that the belts 34,36 pick up just a portion of the labels. The remainder of the label 28 extends off of the belt 34,36, and thus over the film when the belts 34,36 move out over the film.

The belts 34,36 move between sets of peeled labels, so that the labels are placed on the belts in spaced fashion.

Once all of the labels 28 for the rows of labels are positioned on the belts 34,36, the belts 34,36 continue to move until the labels are correctly positioned out over the film 40. Next, the tamping bar 28 lowers to the position illustrated in FIG. 3, pressing the labels 28 against the film.

When the tamping bar 28 is depressed, the portion of each label overhanging the film 40 is pressed against the film 40 between the arm 64,66 and first and second roller 22,24, respectively. Movement of the film 40 then detaches the portion of the label 28 affixed to the belt 34,36. This portion of each label is pressed against the film 40 by the tamping bar 28 as the labels move thereunder.

The parent packaging machine continues to advance the film 40 for placement of the next two rows of labels 28.

Advantageously, the apparatus 20 of the present invention places two rows of labels on the film 40 during a single stop of the film 40. This is accomplished with an apparatus 20 which includes but a single label supplier, peeler and tamping bar.

Further, the manner in which the labels are supplied is cost effective. When these adhesive-backed labels 28 are produced, a sheet containing multiple rows of labels are placed on a sheet backing. The rows of labels are then typically cut apart into single rows and rolled up.

In the instant case, the process of making the labels is simplified in that the cutter need not cut each rows of labels apart. Instead, only every two rows of labels need be cut apart.

The apparatus 20 of the present invention allows a user to adjust the distance between the two rows of labels 28 placed on the film 40. Thus, while the spacing of the labels 28 on their backing is only about 5 mm, the user may place these two rows of labels up to 300 mm apart from one another on the film.

Numerous variations of the device 20 are contemplated as within the scope of the invention. For example, the third roller 26 may be movably mounted with respect to the first and second rollers 22,24 in a number of fashions other than those described above.

The tamping bar 38 may be activated by means other than a motor, such as hydraulic pistons. Further, the bar 38 need not rotate, but could instead be mounted to move vertically up and down.

The apparatus 20 may include a film take-up, as is known in the art. This mechanism allows the film 40 to be advanced between successive stops for label placement without the need to advance the film 40 along the entire length of packaging line.

It will be understood that the above described arrangements of apparatus and the method therefrom are merely illustrative of applications of the principles of this invention and many other embodiments and modifications may be made without departing from the spirit and scope of the invention as defined in the claims.

We claim:

1. An apparatus for placing labels on a packaging film two rows at a time, said apparatus comprising:

a packaging film supply;

a label supply;

means for routing said packaging film through said apparatus, said means comprising a first roller, second roller and third roller, said third roller movably mounted with respect to said first and second rollers;

means for transporting two rows of labels from said label supply across said film; and means for pressing said labels transported by said means for transporting to said packaging film.

2. The apparatus of claim 1, wherein said means for pressing comprises a tamping bar.

3. The apparatus of claim 2, wherein said tamping bar has a first tamping arm and a second tamping arm, said bar oriented such that said first tamping arm presses a first row of said labels against said film at said first roller, and said second tamping arm presses a second row of said labels against said film at said second roller.

4. The apparatus of claim 1, further including means for removing said labels from a backing.

5. The apparatus of claim 1, wherein said label supply comprises two adjacent rows of labels on a common backing.

6. The apparatus of claim 1, wherein said first and second rollers are mounted in a common plane, and said third roller is mounted in another plane.

7. The apparatus of claim 1, wherein said third roller is movably mounted on a slide.

8. The apparatus of claim 1, wherein said means for transporting said labels comprises a first belt and a second belt, said first and second belts extending generally perpendicular to a direction of said film travel.

9. The apparatus of claim 8, wherein said first belt is mounted adjacent said first roller and said second belt is mounted adjacent said second roller.

10. An apparatus for placing labels two rows at a time upon a packaging film comprising:

a first labeling station;

a second labeling station;

means for extending said film between said labeling stations a distance which is greater than the shortest distance between said stations; and means for delivering labels in a first row and second row to said first and second stations.

11. The apparatus of claim 10, wherein said first labeling station comprises a first roller over which said film is routed and said second labeling station comprises a second roller over which said film is routed.

12. The apparatus of claim 10, wherein said means for extending comprises a third roller over which said film is routed between said first and second rollers.

13. The apparatus of claim 12, wherein said third roller is movably mounted to said apparatus with respect to said first and second rollers.

14. The apparatus of claim 10, further including means for pressing said labels against said film.

15. The apparatus of claim 10, wherein said means for delivering said labels comprises a first belt and a second belt.

16. The apparatus of claim 10, further including means for providing adjacent rows of labels upon a single backing to said apparatus for delivery by said means for delivering labels.

17. A method of placing labels two rows at a time upon a packaging film comprising the steps of:

delivering a packaging film;

routing said film to first and second label placement locations;

extending said film a distance between said first and second label placement locations which is greater than the shortest distance between said locations;

delivering a number of labels;

transporting said labels in two rows across said film; and pressing said labels to said film.

18. The method of claim 17, wherein said extending step comprises the step of routing said film around a third roller between said first and second label placement locations.

19. The method of claim 17, wherein said transporting step comprises moving first and second belts generally perpendicular to the length of said film.

20. The method of claim 17, wherein said pressing step comprises lowering a tamping bar against said labels.

* * * * *